United States Patent [19]

Williams

[11] Patent Number: 4,476,943

[45] Date of Patent: Oct. 16, 1984

[54] DRILLING EQUIPMENT WITH ADAPTOR FOR STEERING LONG BOREHOLES

[75] Inventor: David R. Williams, Derby, England

[73] Assignee: Coal Industry (Patents) Limited, London, England

[21] Appl. No.: 335,469

[22] Filed: Dec. 29, 1981

[30] Foreign Application Priority Data

Jan. 23, 1981 [GB] United Kingdom ..... 8102054

[51] Int. Cl.[3] ..... E21B 7/08

[52] U.S. Cl. ..... 175/61; 175/73; 175/406; 192/96; 192/71; 166/237

[58] Field of Search ..... 175/295, 406, 407, 61, 175/101, 73, 76, 74, 75; 166/239, 237, 193; 192/96, 71

[56] References Cited

U.S. PATENT DOCUMENTS

| | | | |
|---|---|---|---|
| 1,844,371 | 2/1932 | Santiago | 175/406 X |
| 2,122,754 | 7/1938 | Rohrbaugh | 166/239 X |
| 2,815,930 | 12/1957 | Storm | 175/295 |
| 3,593,810 | 7/1971 | Fields | 175/61 |
| 4,076,084 | 2/1978 | Tighe | 175/73 |
| 4,108,256 | 8/1978 | Moore | 175/61 |
| 4,319,649 | 3/1982 | Jeter | 175/73 |

FOREIGN PATENT DOCUMENTS 2369412 11/1976 France .

*Primary Examiner*—Stephen J. Novosad
*Assistant Examiner*—Michael Starinsky
*Attorney, Agent, or Firm*—Stevens, Davis, Miller & Mosher

[57] ABSTRACT

Drilling equipment for steering relatively long boreholes in rock strata comprises an adaptor for installation adjacent to the drill bit, the adaptor having an inner rotary component drivably connected between the drill rod assembly and the drill bit and a relatively outer component. Releasable latch means are provided having two operational modes in the first of which the inner and outer components are fixedly engaged for rotary motion and in the second mode of which the inner component can rotate relative to the outer component. Also actuatable means are provided for controlling the operational mode of the releasable latch means.

11 Claims, 6 Drawing Figures

DRILLING EQUIPMENT WITH ADAPTOR FOR STEERING LONG BOREHOLES

This invention relates to drilling methods and equipment.

In particular, although not exclusively, the present invention relates to drilling methods and equipment used for drilling long exploratory bore holes in rock strata.

It is known for such drilling equipment to comprise a rotary drill bit mounted on the end of an extensible drill rod constituted by a plurality of connected drill rod sections which are rotated by a drilling machine and which are induced into the generally horizontally extending borehole to increase its length. It is common practice for the drill bit to have an overall diameter slightly greater than that of the drill rod and for collars or stabilizer to be fitted around the end portion of the drill rod adjacent to the drill bit in order to determine the cutting horizon of the drill bit. Depending upon whether the drill operator desires the drill bit to be urged to move upwardly or downwardly relative to the adjacent rock strata, the axial positions of these stabilizer relative to the bit must be varied.

A problem with the use of such collars is that in order to reposition these collars it is necessary to withdraw all the strings of assembled drill rods. It will be appreciated that this can be a time consuming and tedious operation particularly when the borehole is very long and particularly when the original type of adaptor might have to be refitted once the correct or desired cutting orientation or horizon is achieved.

An object of the present invention is to provide improved drilling equipment.

According to one aspect of the present invention a method of drilling a borehole in rock strata comprises the steps of directing a rotary drill string including a drilling bit to form the borehole, and providing the drill string with a steering adaptor having two alternative operational modes, in the first mode of which a radially outer portion of the steering adaptor rotates with the drill string and in the second operational mode of which the drill string rotates independently of the radially outer portion, of the steering adaptor, means are provided for controlling sections of the operational mode of the steering adaptor.

Preferably, the means is activated by probe means fed down the borehole.

Alternatively, the means is activated by remote control means.

According to a second aspect, the present invention drilling equipment provides steering adaptor for association with a rotary drilling bit mountable on a rotary drill rod string for forming a borehole, the adaptor comprising a relatively inner rotary component drivably connectable to the drill rod and to the drilling bit or drivably connectable to connector components enabling the rotary component to be drivably connectable to the drill rod and to the drilling bit, a relatively outer component arranged at least part way around inner rotary component, releasable latch means having two operational modes in the first mode of which the inner and outer components are fixedly engaged for rotary motion and the second mode of which the inner component can rotate relative to the outer component, and actuatable means for controlling the operational mode of the releasable latch means.

Preferably, the releasable latch means comprises a pivotally mounted latch.

Conveniently, the pivotally mounted latch is provided on the inner component.

Advantageously, the pivotally mounted latch is resiliently biassed into one of its operational modes.

Conveniently, the actuatable means comprises a releasing element for urging the pivotally mounted latch to move against its resilient bias.

Preferably, the actuatable means comprises a pivotally mounted retaining latch operable to retain the releasing element in a position urging the pivotally mounted latch against the action of its resilient bias.

Advantageously, the retaining latch is mounted on a bush slidably mounted along the inner rotary component.

Preferably, the bush is slidable along the inner rotary component under the action of a resilient bias.

Advantageously, the resilient bias comprises two springs.

Conveniently, the two springs act on a common slide member slidable along the inner rotary component.

Advantageously, the resilient bias acts on the releasing element.

Preferably, the drilling equipment comprises probe means slidable along an axial passage defined by the drill rod, the probe means actuating the actuation means to control the releasable latch means.

By way of example, one embodiment of the present invention will be described with reference to the accompanying drawings, in which.

Figure 1:
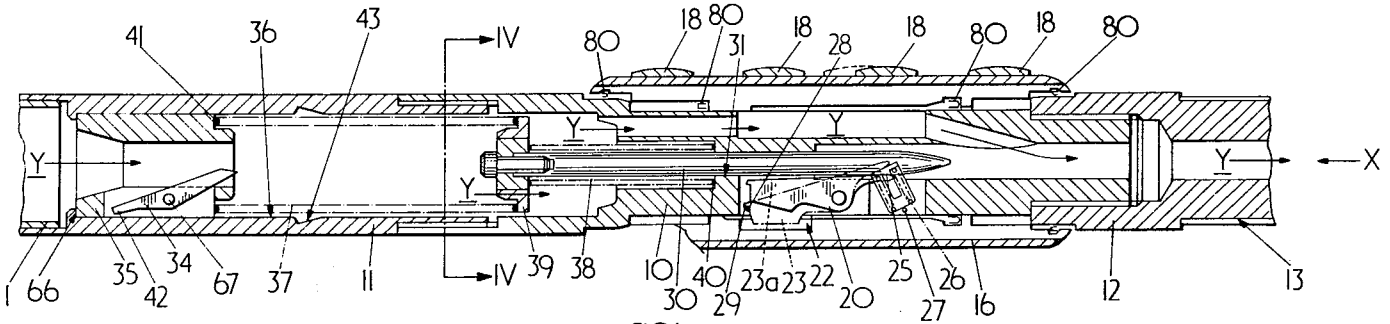
FIG. 1 is a longitudinal section of a part of drilling equipment constructed in accordance with the present invention.

The drawings relate to rotary drilling equipment for drilling long boreholes in rock strata, at least a portion of the borehole extending generally horizontally through the strata. The drilling equipment comprises a rotary drill rod string 1 only one small end portion of which is shown in the drawing constituted by a plurality of drill rod sections connected end to end to define an axial passageway 2 extending substantially the length of the borehole. In operation the passageway permits pressurised drilling fluid to be pumped along the borehole to a rotary drilling bit (not shown) mounted on the extreme end of the drilling rod assembly in order to wash away broken rock particles produced during the cutting or drilling operation. The particles return along the borehole in a relatively outer passageway defined between the outermost cylindrical surface of the drilling rod assembly and the boundary rock wall of the borehole.

In operation the end of the drill rod string remote from the rotary drilling bit and extending from the borehole is drivably connected to the driven chuck of a drilling machine which as well as rotary the drill rod assembly urges the assembly further into the borehole.

The drilling equipment also comprises a steering adaptor mounted between the end of the drill rod assembly remote from the drilling machine and the drill bit, the adaptor comprising a relatively inner rotary component 10 drivably connected to connector components 11 and 12 enabling the rotary component to be drivably connected to the drill rod 1 and to the rotary drill bit (not shown). The drill bit is mounted directly on the threaded portion 13 of the connector component 12.

In other embodiments the inner component is connected directly onto the drill rod assembly and/or onto the drill bit.

As seen in the drawings the connecting and inner components define flow passages for pressurised drilling fluid fed along the passage 2 towards the drill bit to wash away broken rock particles produced during the drilling or cutting operation. Arrows y define one flow path taken by the pressurised fluid. The particles are washed away from the drill bit along a passage defined between the drill rod assembly and the boundary rock walls of the borehole.

Figure 3:
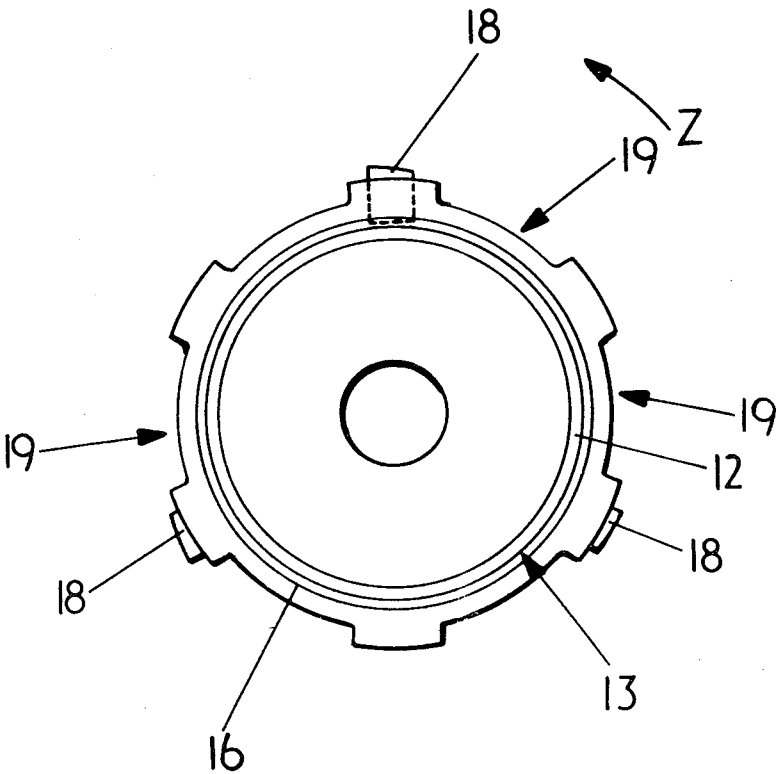
FIG. 3 is an incomplete end view of FIG. 1 looking in the direction of arrow x.
Figure 6:
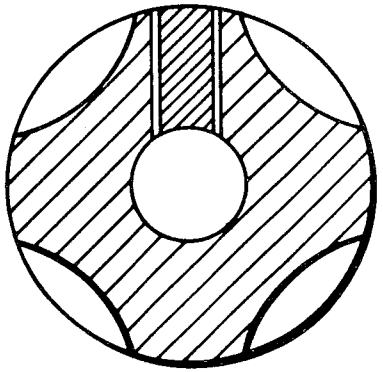
FIG. 6 is an incomplete cross-section taken along line VI—VI of FIG. 2.

The adaptor further comprises an outer component 16 (see FIGS. 1 and 3) extending around the inner rotary component 10 and having rock cutting elements 18 arranged in three circumferentially spaced banks around the outer component. As seen in FIG. 3 the outer wall of the outer component has axially extending recesses 19 permitting the return flow of drilling fluid from the drill bit. Arrow z in FIG. 3 denotes the direction of rotation of the rotary cutter bit. The operation of the cutting elements 18 will be explained later in the specification.

Figure 2:
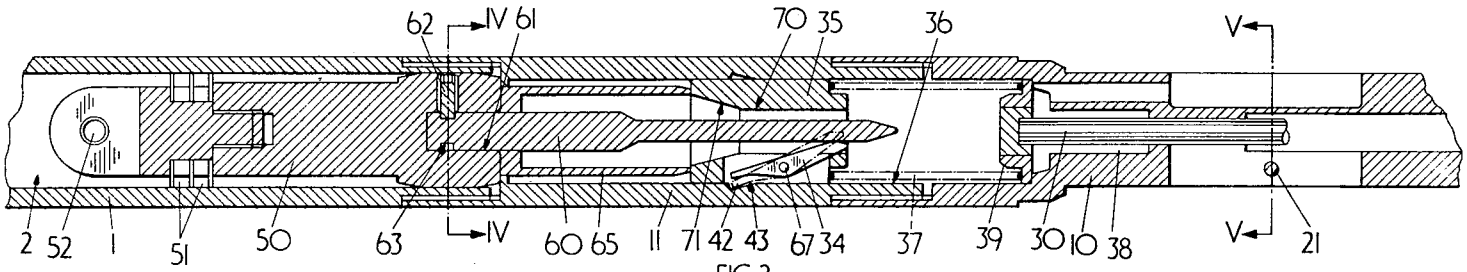
FIG. 2 is a longitudinal section of another part of drilling equipment constructed in accordance with the present invention.
Figure 4:
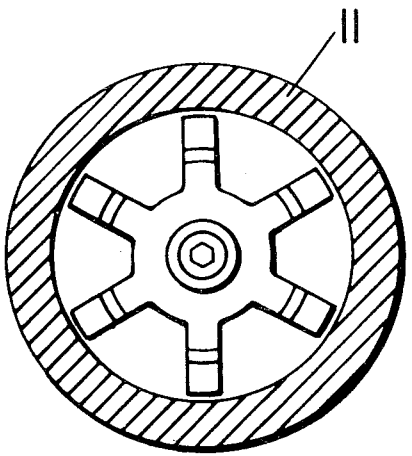
FIG. 4 is an incomplete cross-section taken along line IV—IV of FIG. 1.

The adaptor also comprises releasable latch means constituted by three pivotally mounted latches 20 (only one of which is shown in FIG. 1 and only a pivot support pin 21 of which is shown in FIG. 2). Each latch is capable of pivoting from a first operational mode in which a lip 23 on the latch engages in an associated recess 22 provided in the outer component into a second operational mode in which the lip 23 is clear or disengaged from the recess 22. In FIG. 1 the lip is denoted in both its alternative operational modes, however, the reference number 23*a* is used to denote the lip in its disengaged operational mode.

Figure 5:
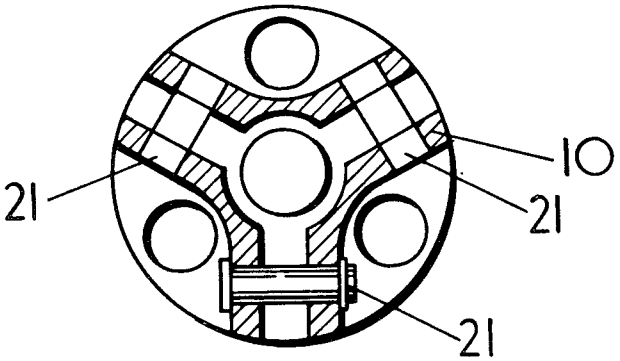
FIG. 5 is an incomplete cross-section taken along line V—V of FIG. 2.

The latch is urged to pivot into its engaged operational mode with the lip 23 engaged in the recess 22 by a resiliently mounted plunger 25 tending to move under the action of a spring 26 arranged between the plunger 25 and a stop pin 27. Pivotal movement of the latch 20 beyond the engaged operational mode is prevented by a further stop pin 28 engaged by an abutment stop 29 provided on the latch. In FIG. 5 only the inner component 10 and the latch support pins 21 are shown.

The releasable latch means are urged to move from their engaged operational modes and against the action of the resilient biasses 25, 26, 27 by the action of a releasing finger element 30 slidable along an axial bore 31 provided by the inner rotary component 10. The releasing finger element 30 constitutes part of actuatable means for controlling operation of the releasable latch means. The actuatable means further comprises a pivotally mounted latch 34 carried by a bush 35 slidably mounted along a slideway 36 defined by the connector component 11. Movement of the bush 35 along the slideway is against the action of resilient means comprising two springs 37 and 38 arranged to abut opposite sides of a slide member 39 also slidable along the slideway 36. The slide members 39 constitutes the head portion of the releasing finger element 30 and moves with the element 30. The spring 38 is arranged to act between a fixed shoulder 40 provided on the inner rotary component 10 and the slide member 39. The spring 37 is arranged to act between the slide members 39 and a shoulder 41 provided on the bush 35.

In use the bush 35 is urged to slide along the slideway 36 until a lip 42 provided on latch 34 engages in an annular retaining recess 43 (as indicated in FIG. 2) provided in the connector component 11. With the lip 42 of the latch 34 engaged in the retaining recess the releasing finger element 30 is moved along the passage 31 towards a drill bit sufficiently for the element 30 to contact the latch 20 which thereby is pivoted into its released operational mode. Movement of the bush 35 will be explained later in this specification.

The drilling equipment also provides probe means comprising a probe activating tool 50 which is slidable along the passageway 2 defined by the drill rod assembly 1. The probe activating tool is slidable along the passageway 2 in a direction towards the drill bit under the action of pressure drilling fluid fed into the passageway 3. Seals 51 are provided on the tool 50 such that it effectively forms a piston slidable within the passageway 2. The probe activating tool 50 is moved along the passage 2 in a direction away from the drill bit by a wire (not shown) trailing behind the tool and secured to an eyelet 52. When it is required to remove the probe activating tool from the adaptor the wire is hauled back along the borehole either manually or by a winch.

The probe activating tool 50 carries a removal releasing probe 60 (see FIG. 2) engaging in an axial bore 61 provided in the front of the tool, the probe being retained in position by a removable cross screw 62 engaging an annular grove 63 formed in the probe. From FIG. 2 it will be appreciated that the probe 60 extends forwardly by distance sufficient to urge the latch 34 to pivot into a released mode in which the lip 42 is clear of or released from the recess 43 thereby allowing the bush 35 to move along the passageway 36 of the connecting component under the action of the springs 37 and 38. Operation of the releasing probe 60 will be explained in more detail later in the specification.

The probe activating tool 50 also carries a removal locking probe 65 which in use can be engaged in the bore 61 and retained in position by the removable cross screw 62 and which when mounted on the front of the activating tool 50 abuts the bush 35 which thereby is urged to move along the slideway 36 against the action of the springs 37 and 38 in order to enable the latch 34 to engage in the recess 43, the activating tool 50 together with the locking probe 65 being urged along the slideway 36 by the action of the pressurised fluid in the passage 2 provided by the drill rod assembly 1. It will be appreciated that although both the probes 60 and 65 are shown in FIG. 2 in position on the activating tool 50 in practise only one of the probes is fitted to the tool at any one time (as will be explained later in this specification), the selection of the particular probe is determined upon whether the drilling machine operator desires the drilling bit to climb in the rock strata or to drill downwards.

In operation, the drilling equipment is aligned at a desired orientation to the rock strata and the drilling procedure started with the drill rod assembly fitted with the drill bit directed generally horizontally into the rock strata. In a typical installation the latch 20 of the releasable latch means is in its released mode such that the rotary component 10 rotates freely relative to the outer component 16 which provides a substantially non-rotary stabilizer for the drill bit. The latch 20 is retained in its released mode by the finger element 30 which is retained in its advanced position under the action of the springs 37 and 38, the bush 35 initially being pushed forward into a position in which the lip 42 of the latch 34 is engaged in the recess 43 to retain the bush 35 in its forward position as seen in FIG. 2.

When the borehole has been drilled into the rock strata to an appreciable depth and the drill rod assembly tends to lay along the floor of the borehole the action of the adaptor tends to direct the drill bit such that the newly formed section of the borehole tends to be inclined upwardly at a relatively shallow angle. Upon the borehole approaching a maximum desired height in the rock strata the probe activating tool 50 fitted with the probe 60 is fed along the passage 2 under the action of the pressure fluid as previously mentioned. Upon the activating tool reaching the adaptor the probe 60 enters the axial bore 70 of the bush 35 to engage the inwardly protruding latch 34 which thereby is pivoted about support 67 to disengage the lip 42 of the latch from the recess 43. Location of the probe 60 in the bore 70 is aided by the tapered inlet 71. Upon the release of the lip 42 from the recess the bush 35 is urged to slide rearwardly along the slideway 36 under the actions of the springs 37 and 38. Simultaneously, the springs urge the head 39 of the finger element 30 to move rearwardly thereby withdrawing the finger element clear of the latches 20 which move under the action of the resilient biasses 25, 26, 27 to engage the lips 23 in the recesses 22. Thus, the outer component 16 now is fixedly secured to the rotary inner component 10 for rotational movement.

Once the latches 20 are engaged in the recesses 43 the activating rod is withdrawn from the borehole by use of the aforementioned trailing wire connected to the eyelet 52, the supply of pressure fluid being previously turned off. It will be appreciated that the use and removal of the activating tool 50 is a relatively rapid procedure delaying the drilling operation for only a relatively short period of time.

Upon drilling being restarted the outer component now rotates with the drilling rod assembly and the cutting elements 18 tend to cut rock from around the borehole sides to increase the borehole diameter in the vicinity of the rotating drill bit. The adaptor which tends to lie on the floor of the borehole tends to follow the newly formed floor of the enlarged diameter borehole and thereby the rotating drill bit tends to follow a lower cutting horizon within the rock strata and the newly formed section of the borehole tends to follow a downwardly inclined direction.

Upon the borehole approaching a maximum desired depth in the rock strata the probe activating tool 50 once more is fed along the passageway 2 defined by the drill rod assembly 1, the tool being fitted with the probe 65. The thrust exerted by the pressure fluid on the tool 50 is sufficient for the probe 65 to move the bush 35 along the slideway 36 against the action of the springs 37 and 38, the bush being moved away from the abutment stop 66 sufficiently for the lip 42 of the latch 34 to engage in the recesses 43 (as indicated in FIG. 2). Upon the lip entering the recess the bush 35 is locked in its foremost position and the activating tool 50 together with the probe 65 can be removed by hauling the wire secured to the eyelet 52.

As the bush 35 is moved forwardly along the slideway 36 against the action of the springs 37 and 38 the same springs urge the finger element 30 to move forwardly along the axial bore of the inner component 10.

This forward movement of the finger element 30 causes the element to engage the latches 20 which thereby are pivoted about the supports 21 to release the lips 23 from the recesses 22, the lips moving into a released position as indicated at **23*a* in FIG. 1. The latch means is retained in the released operational mode by the finger element 30 which is retained in its forward position under the actions of the compressed springs 37 and 38**.

In the described embodiment two separate springs 37 and 38 are provided because it is considered that in operation the stationary (ie non-rotating) latch means 20, 25, 26 may resist forward movement of the finger element along the axial bore of the inner component. It is foreseen that the spring 37 will take up the full forward movement of the bush 35 to allow the latch 34 to engage the recess 43 to retain the bush in its forward position. Upon the drilling operation restarting following the removal of the activating tool 50 it is anticipated the rotary movement of the inner component will free the latch means 20, 25, 26 and allow the finger element to move to its fully advanced position under the action of the springs 37 and 38, the spring 38 becoming fully compressed.

With the latch means 20, 25, 26 in the released mode the inner component 10 is free to rotate relative to the outer component 16 and as previously explained the drill bit tends to be directed along an inclined upward path.

Thus, by use of the drill equipment constructed in accordance with the present invention it is possible to guide the borehole to within a desired accuracy, the adaptor being urged from one operational mode to its other operational mode relatively quickly and simply.

In order that the pressurised drilling fluid can reach the drill bit during the drilling operation to adequately lubricate and cool the drill bit as well as to wash away particles of rock produced during drilling annular seals 80 are provided between the inner and outer components 10 and 16.

In other embodiments of the invention remotely operated means are provided on the steering adaptor for moving the latch means between its two operational modes, the means being controlled by remote control means located remote from the borehole.

I claim:

1. Drilling equipment providing an adaptor for association with a rotary drilling bit mountable on a rotary drill rod for forming a borehole, the adaptor comprising a relatively inner rotary component drivably connectable to the drill rod and to the drilling bit or drivably connectable to connector components enabling the rotary component to be drivably connectable to the drill rod and to the drilling bit, a relatively outer component arranged at least part way around the inner rotary component, releasable latch means comprising a pivotally mounted latch provided on the inner component, the releasable latch means having two operational modes in the first of which the inner and outer components are fixedly engaged for rotary motion and in the second mode of which the inner component can rotate relative to the outer component, the pivotally mounted latch being resiliently biassed into one of the operational modes, and actuatable means for controlling the operational mode of the relesable latch means, the actuatable means comprising a releasing element for urging the pivotally mounted latch to move against the resilient bias and a pivotally mounted retaining latch operable to retain the releasing element in a position urging the pivotally mounted latch against the action of its resilient bias.

2. Equipment as claimed in claim 1, in which the retaining latch is mounted on a bush slidably mounted along the inner rotary component.

3. Equipment as claimed in claim 2, in which the bush is slidable along the inner rotary component under the action of a resilient bias.

4. Equipment as claimed in claim 3, in which the resilient bias comprises two springs.

5. Equipment as claimed in claim 4, in which the two springs act on a common slide member slidable along the inner rotary component.

6. Equipment as claimed in claim 5, in which the resilient bias acts on the releasing element.

7. Equipment as claimed in claim 1, comprising probe means slidable along an axial passage defined by the drill rod, the probe means actuating the actuatable means to control the releasable latch means.

8. The equipment of claim 7 in which the probe means has a portion shaped as a piston to move within said axial passage by action of pressure drilling fluid flowing through.

9. The equipment of claim 8 including means for moving said probe away from drilling bit.

10. The equipment of claim 9 in which the means for moving is a cable attached to the probe and leading to the end of the drill rod remote from said drilling bit.

11. A method of drilling a borehole in rock strata comprising the steps of directing a rotary drill string including a drilling bit to form the borehole, and providing the drill string with a steering adaptor having two alternative operational modes, in the first mode of which a radially outer portion of the steering adaptor rotates with the drill string and in the second operational mode of which the drill string rotates independently of the radially outer portion of the steering adaptor; controlling selection of the operational mode of the steering adaptor by feeding probe means down the bore hole.

* * * * *